United States Patent [19]

Klenk

[11] 3,958,799

[45] May 25, 1976

[54] BUCKLE FOLDING MACHINE

[75] Inventor: Emil Klenk, Murrhardt, Germany

[73] Assignee: Firma Maschinenbau Oppenweiler GmbH, Murrhardt, Germany

[22] Filed: Oct. 24, 1974

[21] Appl. No.: 517,773

[30] Foreign Application Priority Data

Oct. 27, 1973 Germany ..... 2353961

[52] U.S. Cl. ..... 270/68 A

[51] Int. Cl.[2] ..... B65H 45/14

[58] Field of Search ..... 270/68 R, 68 A; 74/397, 74/401; 64/8, 16

[56] References Cited

UNITED STATES PATENTS

| | | | |
|---|---|---|---|
| 1,525,969 | 2/1925 | Waterworth | 270/68 A |
| 1,532,183 | 4/1925 | Higgins | 64/16 |
| 3,057,621 | 10/1962 | Klaus | 270/68 A |
| 3,429,143 | 2/1969 | Sabre | 64/16 |
| 3,510,121 | 5/1970 | Porth | 270/68 A |

FOREIGN PATENTS OR APPLICATIONS

| | | | |
|---|---|---|---|
| 1,067,043 | 10/1959 | Germany | 270/68 A |

*Primary Examiner*—Edgar S. Burr
*Assistant Examiner*—A. Heinz
*Attorney, Agent, or Firm*—Martin A. Farber

[57] ABSTRACT

A buckle folding machine with several folding rollers forming pairs, which with respect to their spacing are adjustably disposed relative to each other and are coupled with a common drive device, which has each one drive wheel for every folding roller, characterized in the manner that the drive wheel of every folding roller is mounted stationary and that all adjustable folding rollers, respectively, are coupled with the coordinated drive wheel over each one equalization coupling, the two hubs of which are connected each other over driving surfaces by an intermediate member which is moveable in a first direction radially relative to the one hub and in a second radial direction extending perpendicular thereto relative to the other hub.

11 Claims, 6 Drawing Figures

BUCKLE FOLDING MACHINE

The invention relates to a buckle folding machine with a plurality of folding rollers forming pairs, which with respect to their spacing are adjustably disposed relative to each other and are coupled with a common drive device, and which has respectively one drive wheel for every folding roller.

Buckle folding machines of this type are used for the folding of paper, foils and the like, and have as a rule four to fourteen folding rollers arranged in the form of steps with two to twelve folding plates or swinging deflectors.

The folding rollers as a rule must be adjusted exactly to the thickness of the running through sheet, or plurality of stacked sheets because they are supposed to take hold and transport the sheet in the entire width uniformly with light pressure. They are able however to yield against spring pressure, so that no disturbances occur if the gap is set somewhat too narrow or if more than the prescribed number of sheets simultaneously runs in. The possibility of the yielding against spring pressure is moreover necessary with certain fold types, particularly with a zig-zag fold or winding or enveloping fold (i.e., a fold in which the ends of a sheet are folded pointing to each other), since the previously folded sheet parts (i.e., the double sheet part about the fold) always run on ahead and the single sheet part extending therefrom (i.e., the yet unfolded part) must begin the next fold.

The correct folding roller adjustment and therewith the uniform spring or resilient pressure are very important for achievement of a straight sheet transport and an exact folding. The reason therefor resides in that paper and foils in some degree are flexible and that between two folding rollers there occurs according to the pressure a more or less larger slipping relative to the circumferential speed of the folding roller. When this slipping is different over the width of the sheet, it thus is compelled to run lopsidedly and then becomes folded crookedly.

With the known buckle folding machines, the drive of the folding rollers takes place exclusively over gears, which sit on the folding roller axles, standing in engagement with the gear of the adjacent folding roller and have a pitch diameter, which is equal to the folding roller diameter. With a drive formed in this manner, a drive torque can be transmitted onto the folding roller axle only together with a force acting in radial direction, because the flanks of the teeth of the gears do not lie in radial planes, but rather are inclined at an angle, which as a rule amounts to 20°. This is disadvantageous, because it is not possible with an economical, yet carriable expense, to continuously perfectly compensate the radial force acting only on the one end of the folding roller. The reason therefore is that the radial force depends not only on the distance between the axes, i.e., the axle spacing of the folding rollers which are adjacent to each other, but also on the rotational speed. A further disadvantage of the known drives is that, at most with a particular size of the axle spacing of adjacent folding rollers, the gears driving them have the correct engagement resulting from the profile form of the teeth. With other axle spacings, the teeth of the gears no longer roll orderly one upon another; and all adjustments of the folding roller which produce a larger axle spacing lead to a play between the interlocking teeth. This play disturbingly acts on the running of the folding rollers and, in the same way as a disorderly rolling of the teeth upon one another, leads to a considerable production of noise. The known measure to be introduced for the reduction of the noise produced by a gear drive, namely gears made of synthetic material, is not usable here since by the disorderly engagement of the teeth, the latter are subject to intense wear and tear if they constitute synthetic material.

The invention is based on the task and it is an object of the invention to produce a buckle folding machine wherein, onto the folding rollers of which, the required drive torque can be transmitted with every adjustable size of the axle spacing of two adjacent folding rollers, without therewith transmitting also a force acting in radial direction of disturbing amount and without having to put up with a disturbing play between the parts transmitting the torque.

With a buckle folding machine of the introductory named type this task is solved according to the invention, and it is another object of the invention to provide a buckle folding machine, in the manner that the drive wheel of each folding roller is mounted stationarily and that all adjustable folding rollers respectively are coupled with the coordinated drive wheel over one equalization coupling each, the two hubs of which are connected operatively in positive (i.e., without friction) rotatable driving manner with each other over driving surfaces by means of an intermediate member which is movable in a first radial direction relative to the one hub, and a second radial direction, extending perpendicular thereto, relative to the other hub. Further in the case where the driving surfaces have breaks, openings or discontinuities in the range of the center of the intermediate member and of the hubs, respectively, the size of the breaks in the radial direction is smaller than the diameter of the axles carrying the hubs, preferably smaller than 50 % of the outer diameter of the hubs.

By the stationary support of the drive gears and the drive of the folding rollers over each an equalization coupling, the drive torque is allowed to be transmitted to the folding rollers without the occurrence therewith of a force acting in radial direction on the folding rollers of disturbing size, since such a force at most can be produced by the friction in the equalization coupling and this friction without difficulty, for example by grease or lubricant or the use of synthetic material with good anti-friction properties can be held extremely small. Radial forces which occur on the drive gears, as this for example is unavoidable with the use of teeth gears, can not take effect on or be transmitted to the folding rollers, not only due to the equalization couplings, but rather also due to the stationary mounting of the drive gears. At every rotational speed of the folding rollers thus the force with which these press on a running-through sheet, over the entire length of the rollers, is equally large and only dependent on the pretaken adjustment of the spacing of the rollers. Further, the necessary drive moment can be transmitted without disturbing play onto the folding rollers, since the equalization or compensating couplings ca be formed play free, or at least their play can be held negligibly small without significant expense, and moreover the stationary support of the drive gears makes possible a play free drive of the same.

By the stationary mounting, the drive wheels can namely mesh in each other continuously in optimum manner if they are formed as gears, and thus without significant play, or the drive wheels can be driven play free for example by means of a belt, in accordance with further objects of the invention. By the avoidance of a play between the parts which transmit the drive torque there is guaranted a straight course of the sheet in the buckle folding machine.

A further essential advantage of the inventive solution resides here that with the invention also with fast running folding machines, the running noise is considerably reduced. This is dependent not only on the avoidance of play between the parts transmitting the torque, but also on the stationary mounting of the drive wheels. When these relate namely to drive gears, then they operate, independent of the size of the axle spacing of the folding rollers from each other, continuously with optimum engagement, and in this manner with minimum running noise. Furthermore in accordance with other objects of the invention, the running noise of the drive can be still reduced in the manner that at times one brings a gear made of metal in engagement with a gear made of synthetic material. The stationary mounting of the drive wheels permits however also the use of a very low noise or noiseless belt drive, because the loading of the drive wheels in radial direction, which is unavoidable with a belt drive, can not take effect on the drive of the folding rollers. With such a belt drive, the running noise is allowed still further to be reduced in comparison to a gear drive.

The stationary mounting of the drive wheels also is advantageous in so far that they make it possible with a formation of the drive wheels as gears, to achieve a very high life of the latter. With the known folding rollers, to the contrary the life of the gears is relatively small, also when they are manufactured of very high-grade material, because with most adjustments of the folding rollers, the teeth of the gears not only roll one upon another, but rather simultaneously undergo a slipping movement.

A further advantage of the solution in accordance with the invention resides in that it permits a very space economizing, light and extremely short construction style in axial direction. This is of considerable significance because the available space standing for the arrangement, both in the radial direction as well as in the axial direction is very small, and the weight is supposed to be held very low, because folding machines as a rule must be transportable. The small space is dependent thereby on the diameter of the folding rollers being relatively small, that several folding rollers are arranged next to each other and that the buckle folding machine in a very different cooperative way is to be assembled, and besides good accessibility and easy operatibility must remain.

These requirements are satisfied also by the solution in accordance with the present invention. Furthermore, it permits in spite of small overall dimensions and a small space requirement, the transmission of sudden shock-like or transient loadings, and high operational rotational speeds (r.p.m.) to be provided, which likewise are important prerequisites for use with modern buckle folding machines. In addition to this as well as to the space economizing construction style of the equalization coupling, the greatest possible extensive utilization of the available space in the axial direction contributes considerably to the aid of the driving surfaces. In accordance with still another object of the invention one obtains a maximum size of the driving surfaces if they are free of breaks, extending from a position on the periphery of the intermediate member and of the hub, respectively, to an opposite position on the periphery. Since in the range of the center of the intermediate member, the driving torque which is transmittable by the driving surfaces is small, as a rule the dimensions of the equalization coupling need not be increased in case the driving surfaces have breaks or openings in the center of the intermediate member and the size of these breaks in the radial direction is smaller that the outer diameter of the hubs, preferably smaller than approximately 50 % of this outer diameter.

The formation of the equalization coupling is possible in different ways. With a preferred embodiment, and it is an another object of the present invention to so provide, the two hubs on the front faces which point to each other are provided each with one rail formation running in a radial direction, and the intermediate member formed as a disc, with two radial grooves running in perpendicular crossing directions, in which, in their longitudinal direction, respectively, the rails are displaceably guided. Of course the rails could be provided also on the disc, and the grooves respectively in the two hubs. With such a formation of the equalization or adjusting coupling, notwithstanding very small axial constructional lengths, relatively large driving surfaces are permitted to be optained, which is of advantage in consideration of the sudden loadings to be transmitted. point Likewise relatively large driving surfaces with a still somewhat smaller axial construction length are allowed to be achieved with an embodiment form of the equalization coupling, and it is yet another object of the present invention to so provide same, with which the two hubs, on the front faces pointing to each other, each have two axial spaced dogs or projections, whose inner surfaces thereof which point to each other lie parallel to each other and to the axis of rotation of the hub. The dogs of one of the hubs interengage hereby between the dogs of the other hub, and the intermediate member is guided in radial direction slidably displaceably on the inner surfaces of the dogs of both hubs, respectively.

Advantageously in accordance with another object of the invention the longitudinal axis of each drive wheel is aligned with the longitudinal axis of the coordinated folding roller in its position corresponding to the center of the adjustment range. The maximum axis displacement or dislocation is then only half as large as with an alignment of the longitudinal axis of the drive wheel on the folding roller in one extreme end position thereof, which has an advantageous effect on the requirements or demands of the surfaces of the equalization coupling which slide upon one another.

It is still another object of the invention to provide the heretofore set forth buckle folding machine, wherein the common drive device constitutes a drive belt, and the wheels are formed as pulleys and are operatively connected with the drive belt.

It is yet another object of the invention to provide the heretofore set forth buckle folding machine, wherein the common drive constitutes a gear drive, and the drive wheels constitute gears made of metal operatively cooperating with gears made of synthetic material, following successively and alternately one upon the other, respectively.

With the above and other objects and advantages in view, the present invention will become more clearly understood in connection with the following description of a preferred and other embodiment examples of the invention illustrated in the accompanying drawings, of which:

Figure 1:
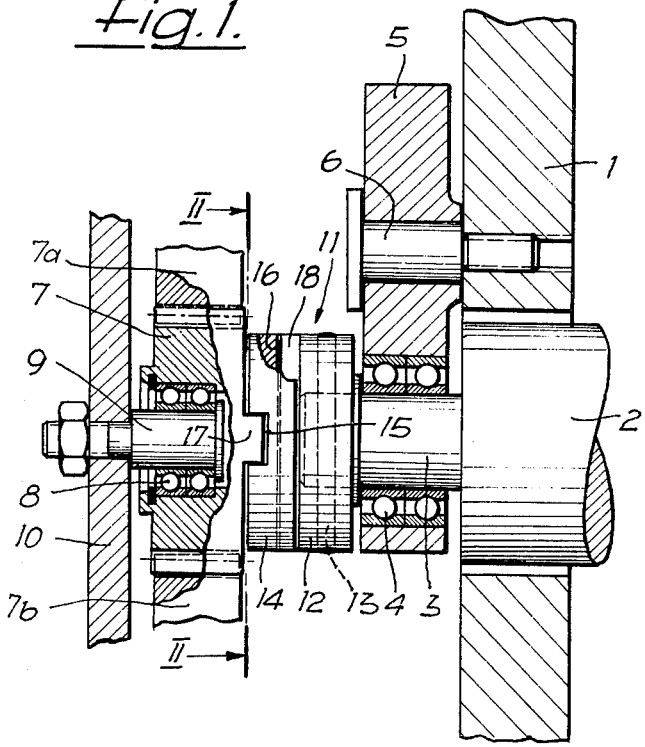
FIG. 1 is a longitudinal section of one roller end with its mounting, the coordinated drive wheel and the coordinated equalization coupling of a first embodiment example of the present invention, with the frame being broken away in part.

In the manner which is conventional with buckle folding machines, several folding rollers 2 are arranged in the form of steps in a frame 1 of a buckle folding machine. Since the support or bearings and the drive of all folding rollers 2 are formed the same, the following explanation, and the illustration of FIG. 1, is limited to a single folding roller as well as to its coordinated part of the drive device.

The bearing pin 3, which is provided at one end of the folding roller 2, is mounted in an anti-friction, ball or roller bearing 4, the latter being held by a bearing plate 5, which plate in the embodiment example is secured on the frame 1 adjustably in radial direction of the bearing pin by means of an eccentric pin 6. In the same way, the folding roller 2 is radially adjustably mounted on its other, not illustrated end.

With the bearing pin 3, in the position of which corresponding to the center of the adjustment range of the folding roller, there is aligned a gear 7 spaced from the bearing pin 3 mounted in overhung position (i.e., mounted from only one end) by means of a ball or roller bearing 8 on a threaded bolt 9, which locks in a bore of a plate 10, the latter being connected rigidly with the frame 1, thus the gear being arranged stationary. The diametrical pitch of the gear 7 is equal to the diameter of the folding roller 2.

The spacing of the gear wheel 7 from the bearing pin 3 of the folding roller 2 is determined by the axial space requirements or overall dimensions of an equalization coupling, the latter being designated as a unit by the reference character 11, which couples the bearing pin 3 with the gear wheel 7. In order to achieve a smallest possible axial distance between the bearing pin and the gear, the latter forms simultaneously the one coupling hub. The other coupling hub 12 is set on the end of the bearing pin 3 which projects beyond the ball or roller bearing 4, and is rigidly connected with the bearing pin 3 by means of a cross pin 13. The outer diameter of the coupling hub 12 in the embodiment example is smaller than the outer diameter of the folding roller 2 although not limited thereto.

A disc shaped intermediate connecting member 14 of the equalization coupling 11 has the same outer diameter, the thickness of which member 14 being slightly smaller that the distance of the front face of the coupling hub 12, which points to the gear wheel 7, from the front face of the gear wheel 7 pointing to it. The intermediate connection member 14 is provided on its both face sides each with one cross groove 15 and 16, respectively, which grooves are rectangular shaped in cross-section, which extend in radial direction over the entire diameter of the intermediate connecting member 14 and stand at right angles relative to each other. Projections or rails 17 and 18, respectively, engage in these two cross grooves 15 and 16, the rails 17 and 18, respectively, being provided on the front faces which point to each other of the gear 7 and of the coupling hub 12, respectively, and in the embodiment example are formed one-piece or integral with the faces, respectively. The dimensions of the rails are selected such that they are allowed to displace without play in the crossgrooves 15 and 16, respectively, in their longitudinal direction. The cooperative abutting lateral sides of the rails and the crossgrooves constitute driving surfaces for a positive (i.e., non-friction) rotatable driving connection.

Since the intermediate connecting member 14 is displaceable relative to the gear wheel 7 and to the coupling hub 12 in directions perpendicular to one another, the drive torque from the gear 7 to the bearing pin 3 is transmitted also then without radial force even if the bearing pin 3 is not aligned axially flush with the screw bolt 9.

The gears **7*a* and 7*b* for other folding rollers (not illustrated) standing in mesh engagement with the gear 7 are likewise disposed stationarily, so that they continuously have the same optimum working depth independent of the adjustment of their folding rollers. Increased running noise and increased wear and tear of the gears are thereby avoided. Moreover swingings or oscillations of the folding rollers are avoided, which occur with the known folding machines when the working depth of the gears is relatively small. The gears 7*a* and 7*b* may be made of synthetic material and the gear 7** of metal, and cooperatively engaging with each other successively and alternately, i.e., a synthetic material gear, a metal gear, a synthetic material gear, etc.

Figure 2:
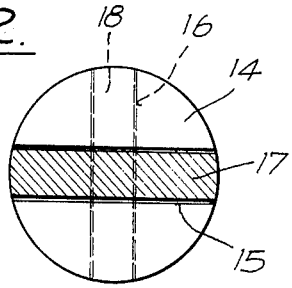
FIG. 2 is a section along the lines II — II of FIG. 1.
Figure 3:
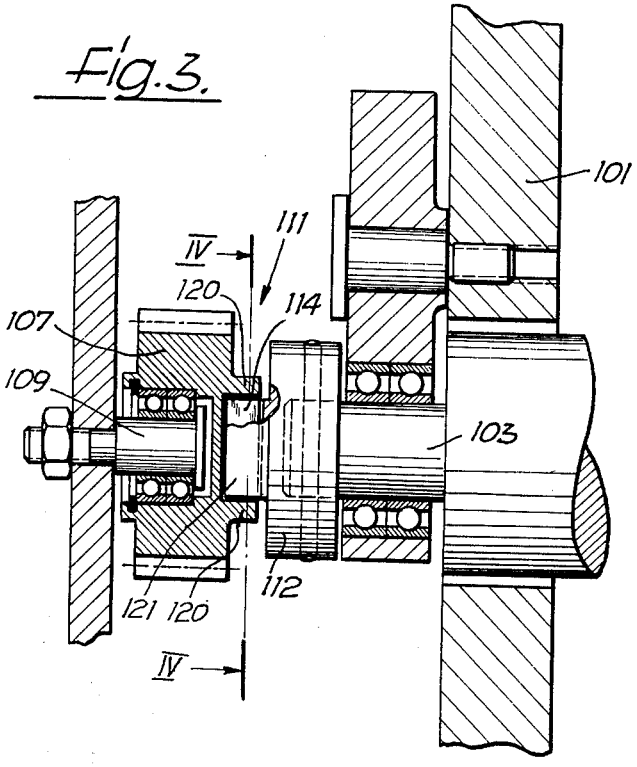
FIG. 3 is a sectional view corresponding to that of FIG. 1 of a second embodiment example in accordance with the present invention.
Figure 4:
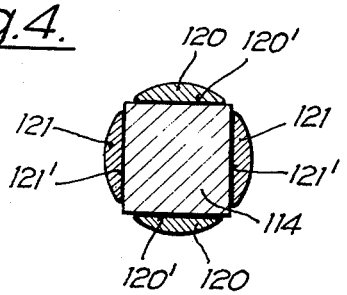
FIG. 4 is a section along the lines IV - IV of FIG. 3.

Referring now again to the drawings and more particularly to FIGS. 3 and 4, another embodiment example of the invention is illustrated, which differs from that of FIGS. 1 and 2 only by another formation of the equalization or balance coupling. The stationary gear 107 forms here as in the first embodiment example, simultaneously the one coupling hub of the equalization coupling, the latter being designated as a unit by the reference character 111. Further, the other coupling hub 112 is set on the bearing pin 103 and is bolted with the latter. Deviating from the equalization coupling 11, however, with the equalization coupling 111, on the front faces, which point to each other, of the gear wheel 107 and of the coupling hub 112, there are provided each two projecting standing-out dogs 120 and 121, respectively, which interengage into each other; and as shown in FIG. 4, with their inner surfaces 120' and 121', respectively, which face each other and are parallel to one another as well as to the longitudinal axis, bound a hollow space which is square or quadratic in cross-section. In this hollow space, the intermediate member 114 is inserted, which with its jacket or shell surface slidably displaceably abuts on the inner surfaces 120' and 121', respectively. The cooperative abutting surfaces of both the intermediate member 114 and the dogs (of the two hubs) constitute driving surfaces for the positive (i.e., non-friction) rotatable driving connection. Since as FIG. 4 shows, the length of the edges of the quadratic cross-section surfaces of the intermediate member 114 is greater that the length of the chord which limits the circular segment shaped cross-section surface of the dogs 120 and 121, the equalization coupling 111, likewise as the equalization coupling 11, permits a radial shifting or dislocation of the axis of the bearing pin 103 with respect to the axis of the screw bolt 109 carrying the gear 107, notwithstanding that the dogs 120 and 121 interengage in each other.

Figure 5:
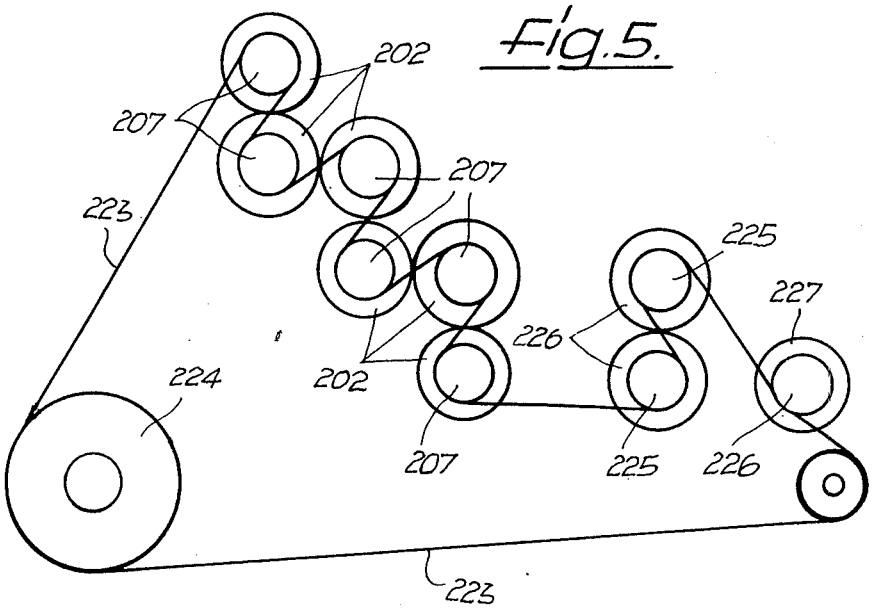
FIG. 5 is a schematic side view of the drive apparatus of a third embodiment example of the invention.

By the embodiment example illustrated in FIG. 5, the bearing or supporting of the folding rollers 202 and their coupling with the coordinated drive wheel can be formed as with one of the heretofore described embodiment examples. The difference with respect to these embodiment examples resides in another formation of the drive device. As shown in FIG. 5, instead of the gears there are provided pulleys 207 over which a drive belt 223 is guided. The embodiment example relates herewith to a tooth belt.

A flat belt however could also be used.

The drive belt 223 runs not only over the pulleys 207 and a drive disc 224, but rather in the embodiment example also still over pulleys 225, by means of which two perforated- and grooved rollers or -pulleys 226 and an exit roller 227 are driven. The formation of the drive device as a belt drive has first of all the advantage that the operating noise is allowed to be held very low, also with high rotational speeds.

Figure 6:
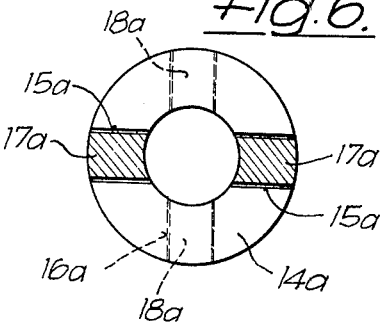
FIG. 6 is a view corresponding to that of FIG. 1 illustrating an embodiment with breaks in the driving surfaces.

FIG. 6 shows an embodiment similar to that of FIGS. 1 and 2 but with the driving surfaces formed with breaks. For example, a ring shaped intermediate member 14*a* has cross-grooves 15*a* and 16*a* each with breaks in the center, and rails 17*a* and 18*a* having breaks in the center are cooperatively disposed in the respective cross-groove.

While I have disclosed several embodiment examples of the invention, it is to be understood that these embodiment examples are only provided for example only and not in a limiting sense.

I claim:

1. A buckle folding machine comprising a plurality of adjustably mounted folding roller pairs adjustable with respect to their spacing relative to each other, said plurality of folding roller pairs comprising a plurality of adjustable folding rollers, a common drive means operatively coupled to said folding rollers for synchronous drive thereof comprising a stationarily mounted drive wheel for each adjustable folding roller, one equalization coupling means each for operatively coupling an associated of said drive wheel with said each adjustable folding roller, respectively, said equalization coupling means having two hubs each rotatable about one axis of rotation, respectively, and relative to the axis of rotation of one of said hubs defining a first radial direction and relative to the axis of rotation of the other of said hubs defining a second radial direction, said axis of rotation of one of said hubs being aligned or spaced parallel, with respect to the axis of rotation of the other of said hubs, said equalization coupling means including an intermediate member means and driving surface means for operatively connecting said two hubs positively for rotation with each other and for operatively moving said intermediate member means in said first radial direction relative to one of said hubs and in said second radial direction relative to the other of said hubs, aid first and second radial directions being perpendicular to each other, for transferring required turning moment from the associated drive wheel to said each adjustable folding roller.

2. The buckle folding machine, as set forth in claim 1, wherein said driving surface means constitute continuous surfaces, respectively.

3. The buckle folding machine, as set forth in claim 1, wherein said driving surface means are each formed with an opening in a center range of said intermediate member means and of said hubs, respectively, said hubs define outer diameters thereof, and said opening in said radial directions is smaller that said outer diameters of said hubs.

4. The buckle folding machine, as set forth in claim 3, wherein said opening in said radial direction is smaller than 50 % of said outer diameters of said hubs.

5. The buckle folding machine, as set forth in claim 1, wherein said two hubs have front faces respectively pointing to each other, said hubs each have one rail on each of said front faces running in said first and second radial directions, respectively, said intermediate member means is formed as a disc having two cross grooves running radially and in perpendicular crossing directions, said cross grooves each define a longitudinal direction, and said rails are displaceably guided in said cross grooves, respectively, in said longitudinal directions of the latter.

6. The buckle folding machine, as set forth in claim 5, wherein said rails and grooves extend from a peripheral position on a surface of a corresponding of said hubs and intermediate member means, to an opposite peripheral position thereof.

7. The buckle folding machine, as set forth in claim 1, wherein said two hubs have front faces respectively pointing to each other, said hubs each have two dogs on each of said front faces, said two dogs of each of said hubs are spaced apart from said axis of rotation of a corresponding of said hubs, said two dogs have inner surfaces which point to one another and which lie parallel to each other and to said axis of rotation of a corresponding of said hubs, said two dogs of each of said hubs are disposed substantially between said two dogs of the other of said hubs, respectively, and said intermediate member means is guided in said first and second radial directions slidably on said inner surfaces of said dogs of said two hubs, respectively.

8. The buckle folding machine, as set forth in claim 1, wherein said folding rollers are adjustable over an adjustment range, said drive wheel and said folding roller each define a longitudinal axis of rotation, respectively, and the longitudinal axis each of said drive wheel is aligned with the longitudinal axis of an associated of said folding roller in a position thereof corresponding to a middle of said adjustment range.

9. The buckle folding machine, as set forth in claim 1, further comprising a common drive constituting a drive belt, and said drive wheels are formed as pulleys and are operatively connected with said drive belt.

10. The buckle folding machine, as set forth is claim 1, further comprising said common drive means for said drive wheels constituting a gear drive, and said drive wheels constitute a gear made of metal operatively engaging with gears made of synthetic material, the latter operatively engaging with other gears made of metal.

11. The buckle folding machine, as set forth in claim 1, wherein said folding rollers are adjustable over an adjustment range, one of said hubs is jointly rotatably connected with said drive wheel and the other of said hubs is jointly rotatably connected with said folding roller, said axis of rotation of each of said hubs, respectively, are aligned, or spaced parallel relative to each other within said adjustment range, and said driving surface means for moving said intermediate member means in said radial directions are substantially aligned in said first and second radial directions.

* * * * *